US006486607B1

(12) United States Patent
Yeuan

(10) Patent No.: US 6,486,607 B1
(45) Date of Patent: Nov. 26, 2002

(54) CIRCUIT AND SYSTEM FOR DRIVING ORGANIC THIN-FILM EL ELEMENTS

(76) Inventor: Jian-Jong Yeuan, No. 13, Lane 173, Ta-Kuang Street, Nan Tun, Taichung (TW)

( * ) Notice: Subject to any disclaimer, the term of this patent is extended or adjusted under 35 U.S.C. 154(b) by 0 days.

(21) Appl. No.: 09/909,341

(22) Filed: Jul. 19, 2001

(51) Int. Cl.[7] ..... G09G 3/10

(52) U.S. Cl. ..... 315/169.1; 315/169.3; 345/204; 345/84; 345/77

(58) Field of Search ..... 315/169.3, 169.1, 315/164, 167; 345/55, 76, 77, 84, 204

(56) References Cited

U.S. PATENT DOCUMENTS 5,844,368 A 12/1998 Okuda et al.
6,201,520 B1 3/2001 Iketsu et al.
6,229,267 B1 * 5/2001 Ushigusa et al. ..... 315/169.4
6,310,589 B1 * 10/2001 Nishigaki et al. ..... 345/76
6,351,076 B1 * 2/2002 Yoshida et al. ..... 315/169.1
6,369,515 B1 * 4/2002 Okuda ..... 315/169.3
6,376,994 B1 * 4/2002 Ochi et al. ..... 315/169.1

* cited by examiner

*Primary Examiner*—Haissa Philogene

(57) ABSTRACT

The present invention discloses a circuit and system for driving an organic thin-film electroluminescent (EL) display to emit light. The driving system of the present invention can quickly respond to the point of emission when a supply voltage is applied. This driving system includes a plurality of intersecting anode and cathode lines arranged in a matrix. The anode lines are the scanning lines, and the cathode lines are the driving lines. A plurality of organic thin-film EL elements is positioned at the intersection of scanning and driving lines. Each of the organic thin-film EL elements is electrically connected to one of the scanning lines and one of the constant current sources followed by connecting to one of the driving lines. The signal control unit controls the scan lines causing at least one of these elements to emit light by executing scanning of at least one of the scan lines and, during a predetermined period of the scanning, by coupling a driving source to at least one of the driving lines in the scanning period.

12 Claims, 10 Drawing Sheets

CIRCUIT AND SYSTEM FOR DRIVING ORGANIC THIN-FILM EL ELEMENTS

BACKGROUND OF THE INVENTION

1. Field of the Invention

The present invention relates to a circuit and system for driving an organic thin-film electroluminescent (EL) display to emit light, and particularly to a circuit and system for driving the organic thin-film EL element to emit light at a specified constant driving current.

2. Description of Related Art

The light-emitting luminance of the organic thin-film EL elements varies when the driving current flowing into the element varies. To control the uniformity of luminance of organic thin-film EL element, the driving current flowing into the element must be controlled and maintained at a specified constant current level among the organic thin-film EL elements.

FIG. 1 shows a prior art driving circuit. In FIG. 1, a constant current supply 13 intends to change the driving current, which is supplied from a power supply 11 to a light-emitting element 12. It should be noted that the light-emitting element 12 emits light when a switch 14 is open as indicated by solid line, and ceases to emit light when the switch 14 is closed as indicated by dotted line.

FIG. 2 shows another prior art driving circuit. In this configuration, a high resistance 15, which is inserted in series between a light-emitting element 12 and a power supply 11, intends to control the driving current flowing through the light-emitting element 12 to be a constant. It should be noted that the light-emitting element 12 emits light when a switch 16 is located at a position indicated by solid line, and ceases to emit light when the switch 16 is changed to another position indicated by dotted line.

The organic thin-film EL element can be modeled as an equivalent circuit composing a diode 32 and a parasitic capacitor 31 connected in parallel, as shown in FIG. 3. The parasitic capacitor 31 within the equivalent circuit always causes a response problem, especially in a matrix of organic thin-film EL elements. The organic thin-film EL elements cannot emit light normally unless a voltage difference between both ends exceeds a specified forward voltage $V_f$. The forward voltage $V_f$ of LED is as low as +1.5 V to +2 V and also relatively stable. On the other hand, the forward voltage of the organic thin-film EL is as high as +5 V to 12 V and also greatly vanes in accordance with luminance, temperature and time passage. Besides, the parasitic capacitance effect is more severe in an organic thin-film EL element than in a LED due to a higher forward voltage $V_f$. The forward voltage $V_f$ has to rise above the specified voltage value for luminance and the rise time is depended on the total charging time of all the parasitic capacitors parasitizing in the organic thin-film EL elements. Normally, the power supply is required to boost to a $V_{cc}$ voltage potential higher than the forward voltage $V_f$ in order to drive the organic thin-film EL element to emit light.

FIG. 4 shows a prior art driving system 40 for driving luminous elements. In FIG. 4, the prior art driving system 40 is constructed with a matrix arrangement of the number of N×M (only 6×5 organic thin-film EL elements appear in FIG. 4), in which the cathode-scanning unit consists of N number of cathode scanning lines. The cathodes of organic thin-film EL elements are connected to the switches $\mathbf{7}_1$ to $\mathbf{7}_n$ through the cathode scanning line $X_1$ to $X_n$ for selecting a power potential $V_B$ or a ground potential. The anode data-driving unit consists of M number of anode data-driving lines. The anode data-driving lines $Y_1$ to $Y_m$ are individually connected to the switches $\mathbf{11}_1$ to $\mathbf{11}_m$ with constant current supplies $\mathbf{10}_1$ to $\mathbf{10}_m$ and ground. The prior art driving system 40 causes the luminous elements at an arbitrary intersection to emit light by selecting and scanning one of the anode lines and the cathode lines sequentially at fixed time intervals.

Accordingly, the prior art driving system 40 always causes problems once used in driving a matrix of organic thin-film EL elements for luminance. The main problem is that the scanning speed will be slowed down due to the parasitic capacitors described above. When the organic thin-film EL is used as a luminous element, this problem becomes more severe since the organic thin-film EL has a large capacitor to generate a surface emission. The above problem is more severe when the number of the luminous elements increases since the organic thin-film EL will to accumulate all the parasitic capacitors. Furthermore, the parasitic capacitors of all luminous elements connected to the anode lines have to be charged, and the current sources for driving the luminous elements connected to each anode line must be designed large enough to satisfy the appropriated response time. This requirement for generating large current sources is detrimental from the aspect of miniaturization of the circuit.

FIG. 5 is a timing chart of the driving system shown in FIG. 4. FIG. 5 shows the parasitic capacitor problem in the switching operations of the switches $\mathbf{7}_{i-1}$, $\mathbf{7}_{i+1}$, $\mathbf{7}_{i+1}$, and $\mathbf{11}_j$. The potential of $Y_j$ data electrodes cannot increase at once due to the parasitic capacitance in the reverse bias direction of at least (n−1) pixels. A delay time $t_d$ occurs until a forward bias is applied to the pixel D(i, j) for light emitting. In addition, the current source $\mathbf{10}_j$ will limit the increasing rate of the potential of the $Y_j$ data electrodes and results in a larger delay time $t_d$.

FIG. 6 shows a current response when an input voltage pulse is applied to an organic thin-film EL element. In FIG. 6, a curve 61 represents the organic thin-film EL element current response, and a curve 62 represents the voltage pulse. It is clear that the rise time is longer than the fall time. This indicates that the time for capacitance discharge is shorter than the time for capacitance charge in the organic thin-film EL element. The advantage of a shorter capacitance discharge time can be used to develop a fast response driving circuit for an organic thin-film EL display. In the prior art driving system shown in FIG. 4, a constant current source $\mathbf{10}_j$ is connected to a set of parallel organic thin-film EL elements, D(l, j) through D(n, j), following to the ground potential in D(i,j) and to reverse power potential in rest of D(l to i−1, j) and D(i+1 to n, j). Normally, the constant current source is sourcing a magnitude of current to light up an organic thin-film EL element. It should be noted that the parasitic capacitors in parallel could enhance the parasitic capacitance effect compared to that of a single organic thin-film EL element. The current source limits the current and worsens the response to emit light of the scanned organic thin-film EL element D(i, j) due to the above parasitic capacitance effect when a power potential is applied. Several methods to improve the response to emit light in prior art organic thin-film EL display driving system is proposed in U.S. Pat. No. 6,201,520 and No. 5,844,368. However, the above methods do not really resolve the existent problems.

SUMMARY OF THE INVENTION

The object of the present invention is to resolve the problems and disadvantages of the related art. The present invention provides a driving circuit for driving an organic thin-film EL element to emit light. Furthermore, a driving system organized by the driving circuits of the present invention is applied to drive an organic thin-film display.

In a first embodiment of the present invention, a driving circuit for driving an organic thin-film EL element comprises an anode-scanning switch, an organic thin-film EL element, a constant current source and a cathode data-driving switch. The anode-scanning switch is connected to a power potential while being scanned and connected to a ground potential otherwise. The organic thin-film EL element is connected to the anode-scanning switch. The constant current source is connected to the organic thin-film EL element. One end of the cathode data-driving switch is connected to the constant current source, and another end of the cathode data-driving switch is connected to a ground potential while the organic thin-film EL element is selected. Otherwise, the other end of the cathode data-driving switch is connected to a power potential.

In a second embodiment of the present invention, a driving circuit for driving an organic thin-film EL element comprises an anode scanning unit, an m×n matrix of organic thin-film EL elements, n columns of constant current sources, a cathode data-driving unit and a signal control unit. The anode scanning unit includes m rows of anode-scanning switches, each anode-scanning switch connected to a power potential while being scanned and connected to a ground potential otherwise, wherein m is an integer. The organic thin-film EL elements at the same row are connected to a corresponding anode-scanning switch. The organic thin-film EL elements at the same column are connected to a corresponding constant current source. The cathode data-driving unit includes n columns of cathode data-driving switches, one end of each cathode data-driving switch connected to the constant current source, another end of the cathode data-driving switch connected to a ground potential while the organic thin-film EL element is selected and connected to a power potential otherwise. The signal control unit is used to switch the anode-scanning switches and the cathode data-driving switches.

In order to enhance the response to emit light of pixels composed by the organic thin-film EL elements in a line during the line scanning, the driving system for driving the organic thin-film EL display includes a plurality of intersecting anodes and cathode lines arranged in a matrix, a matrix of organic thin-film EL elements, a plurality of constant current sources and a signal control unit. In this driving system, the anode lines are scanning lines, and the cathode lines are data-driving lines corresponding to the driving circuit in the first embodiment of the present invention; each of the organic thin-film EL elements is coupled to one of the scan lines and one of the driving lines at a point where the scan lines and driving lines intersect. The scanning lines and driving lines are connected and controlled through the signal control unit. Each driving line is connected to a constant current source before connecting to the signal control unit, which can cause at least one of the organic thin-film EL elements to emit light by scanning one of the scan lines for a predetermined period of time in a scanning process and which is coupled to the data-driving lines. In order to increase the response to emit light in the organic thin-film EL display, the data pulses are set at least one clock time ahead of the scanning pulse. The signal control unit sets a power potential to a scan line by coupling the rest of the scan lines to ground potential.

By the construction described above, when the scanning position is switched to the next scan line with a power potential and the rest of the scan lines are set to a ground potential, the parasitic capacitor of the organic thin-film EL element which emits light is charged by the scanning source via the scan line, and the parasitic capacitor of the organic thin-film EL element that does not emit light is charged under the presence of the reverse bias voltage of the driving lines at the same time. The arrangement allows an instant build up of a forward voltage for the organic thin-film EL element that is to emit light, and the organic thin-film EL element can quickly respond to emit light.

These and other features and advantages of the present invention will be understood upon consideration of the following detailed description of the invention and the accompanying drawings.

BRIEF DESCRIPTION OF THE DRAWINGS

The present invention will be described according to the appended drawings in which.

PREFERRED EMBODIMENT OF THE PRESENT INVENTION

Figure 1:
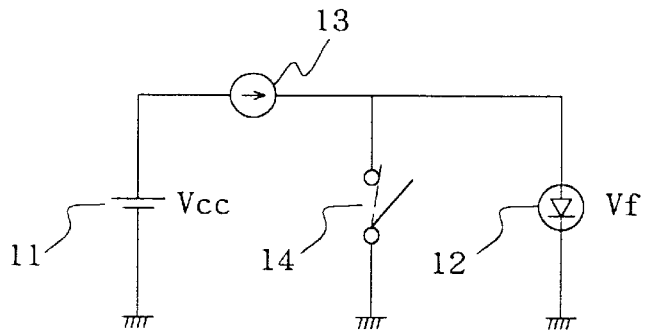
FIG. 1 (Prior Art)
FIG. 1 shows a prior art driving circuit.
Figure 2:
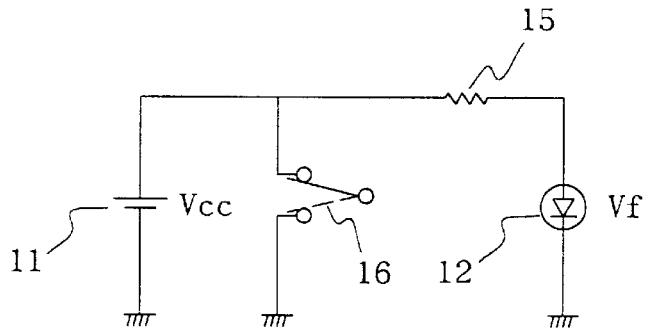
FIG. 2 (Prior Art)
FIG. 2 shows another prior art driving circuit.
Figure 3:
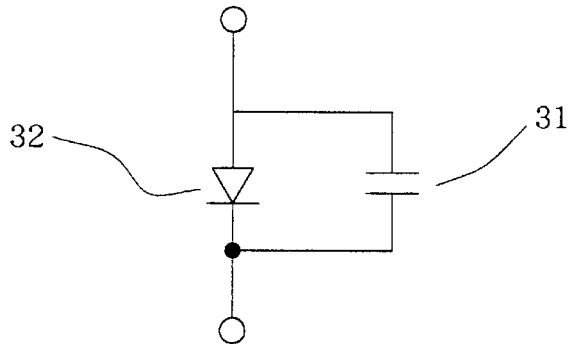
FIG. 3 (Prior Art)
FIG. 3 shows an equivalent circuit of the organic thin-film EL element.
Figure 4:
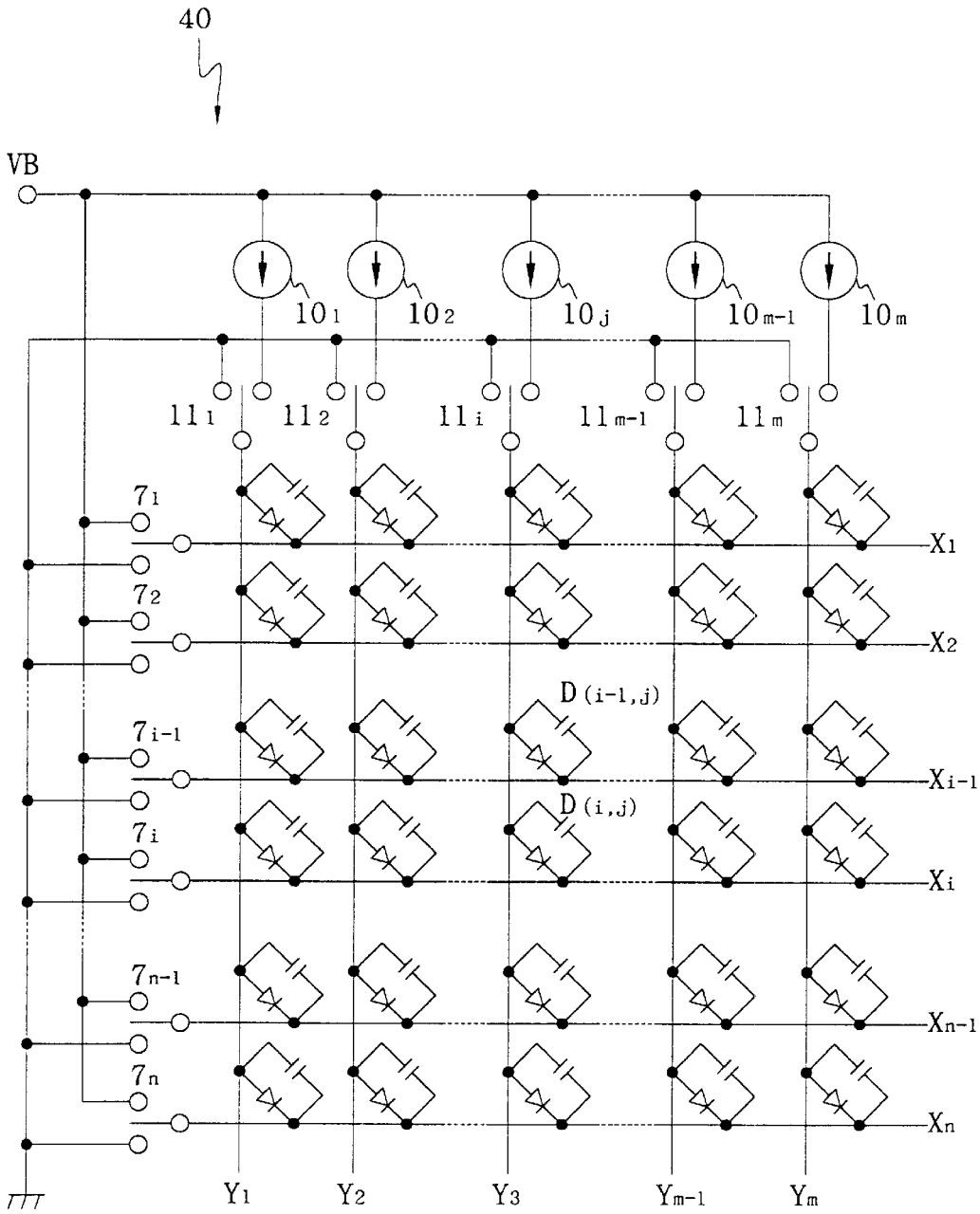
FIG. 4 (Prior Art)
FIG. 4 shows a prior art driving system for driving luminous elements.
Figure 5:
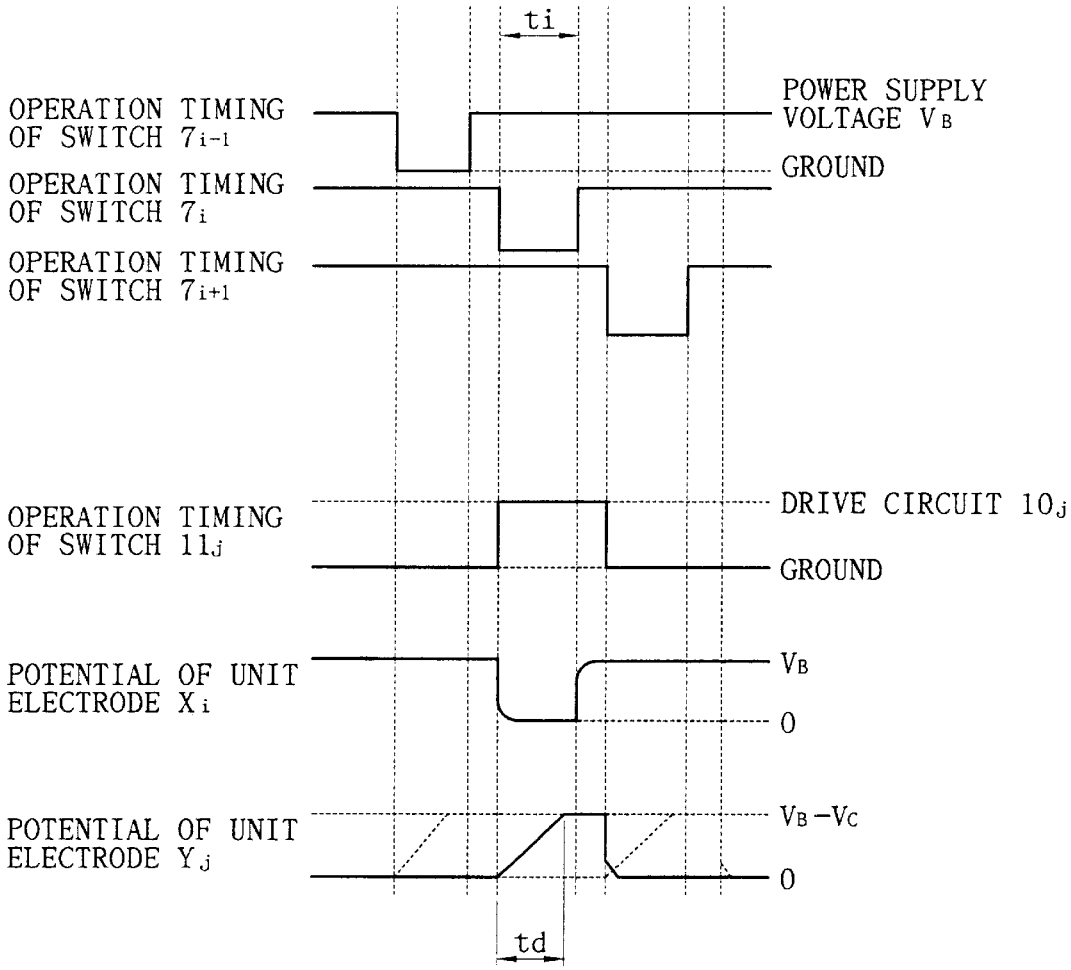
FIG. 5 (Prior Art)
FIG. 5 is a timing chart of the driving system shown in FIG. 4.
Figure 6:
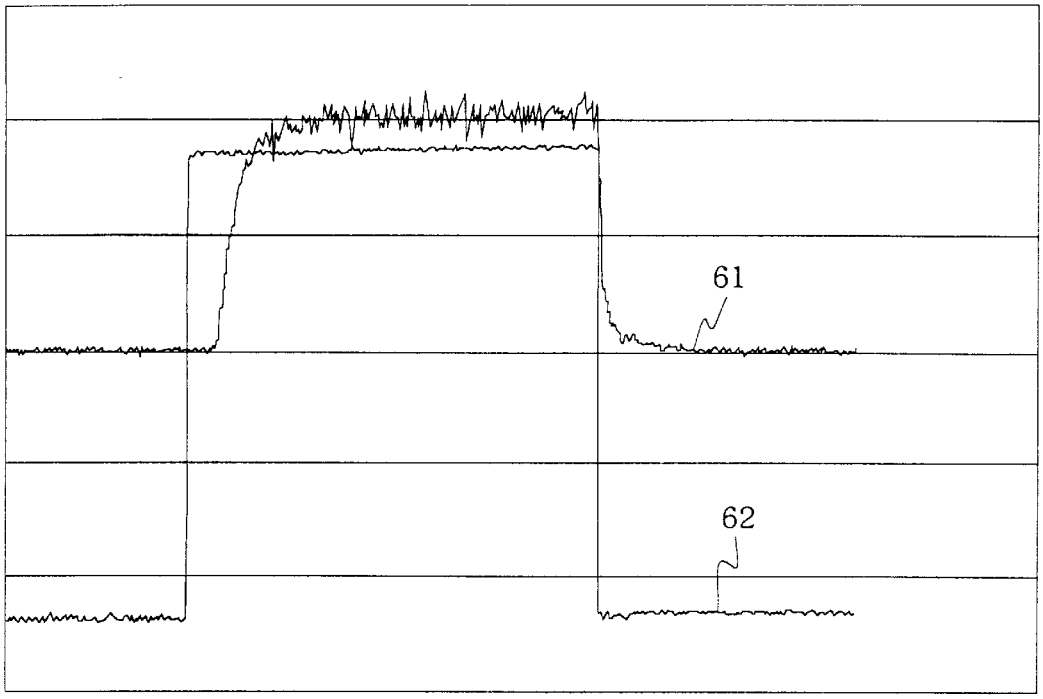
FIG. 6 (Prior Art)
FIG. 6 shows a current response when an input voltage pulse is applied to an organic thin-film EL element.
Figure 7:
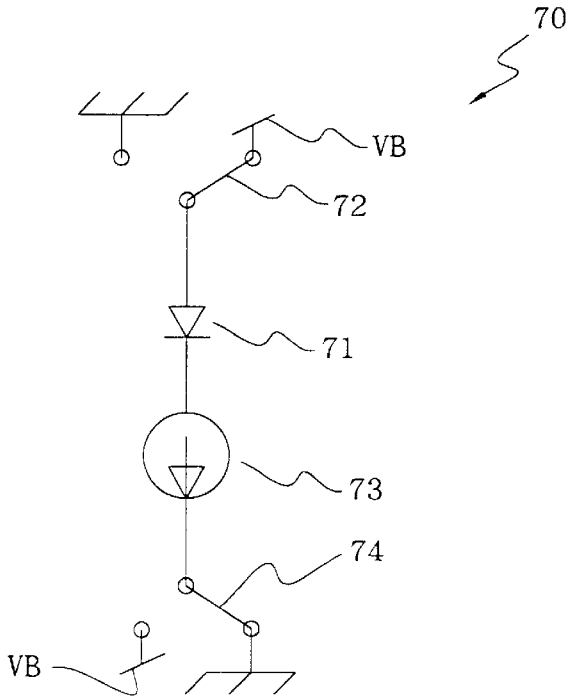
FIG. 7 shows a driving circuit for an organic thin-film EL element according to a first embodiment of the present invention.
Figure 8:
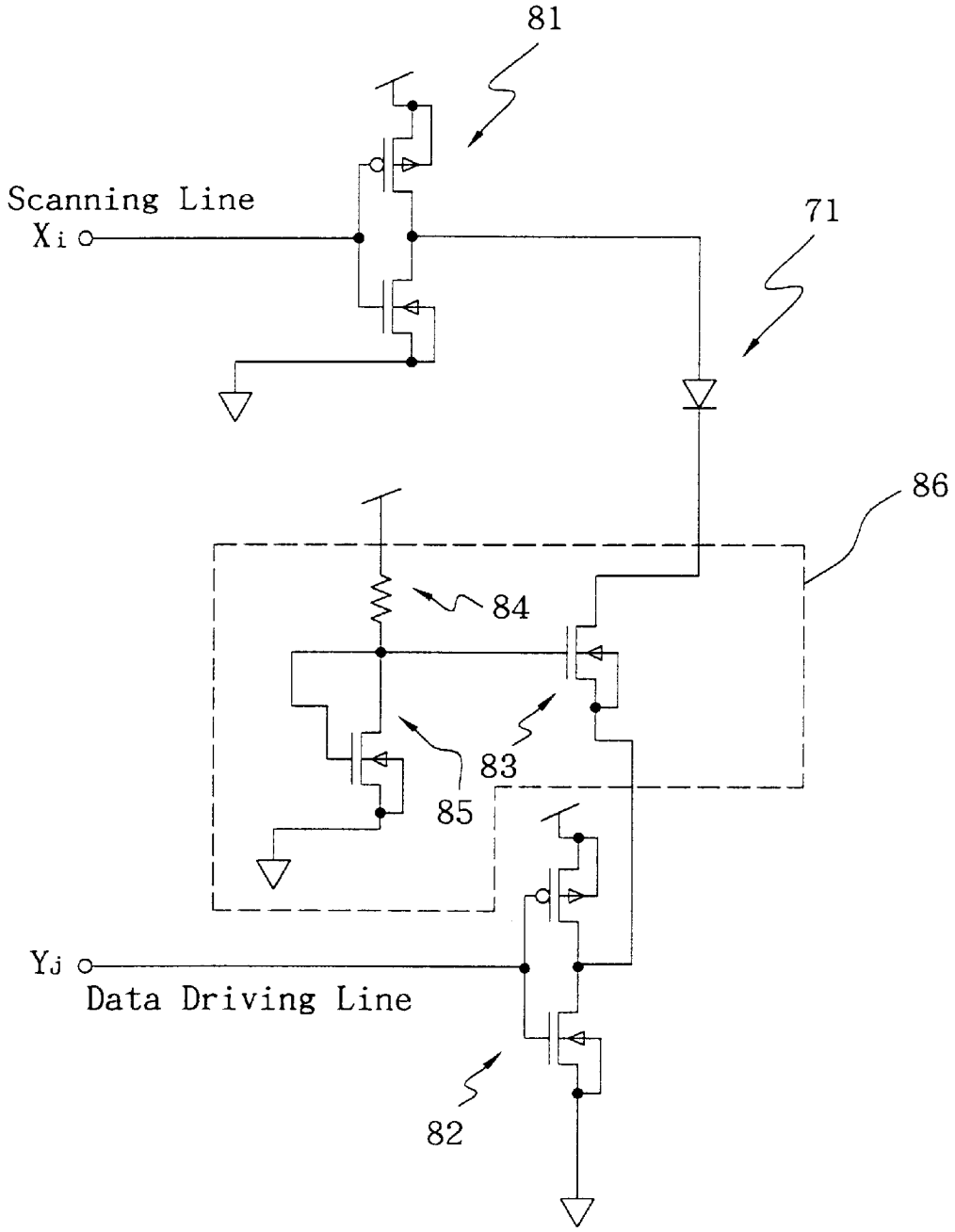
FIG. 8 shows an equivalent circuit to the first embodiment of the present invention.
Figure 9:
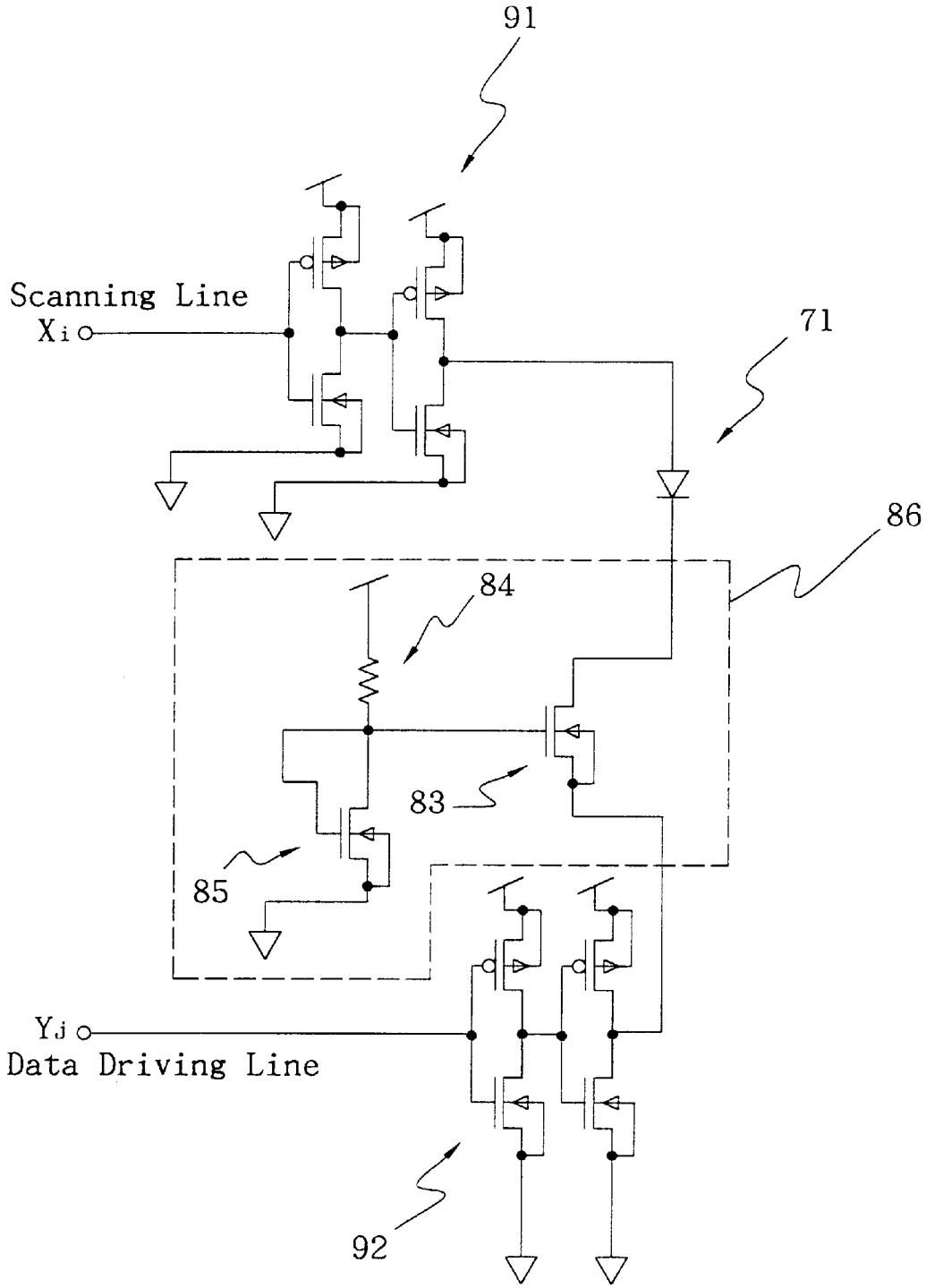
FIG. 9 shows another equivalent circuit to the first embodiment of the present invention.

FIG. 7 shows a driving circuit 70 for an organic thin-film EL element according to a first embodiment of the present invention. In this driving circuit 70, an organic thin-film EL element 71 is connected between an anode-scanning switch 72 and a constant current source 73, and the current output from the constant current source 73 flows to a cathode data-driving switch 74. Both the anode-scanning switch 72 and cathode data-driving switch 74 are switches which are switched between a power potential and a ground potential. The anode-scanning switch 72 and the cathode data-driving switch 74 are used to control the emission of the organic thin-film EL element 71. The anode-scanning switch 72 is connected to a power potential while the organic thin-film EL element 71 is scanned and connected to a ground potential otherwise; the cathode data-driving switch 74 is connected to a ground potential while the organic thin-film EL element 71 is selected and connected to a power potential otherwise. A technical advantage of the driving circuit 70 according to the present invention is that the organic thin-film EL element 71 is quickly charged and discharged without a limit of current. This advantage is more significant in a parallel structure composing lots of organic thin-film EL elements where the parasitic capacitance effect is severe. Normally, the organic thin-film EL element 71 needs to be charged first before the current flows through it to emit light, FIG. 8 and FIG. 9 show equivalent circuits to the first embodiment of the present invention. In FIG. 8, the anode-scanning switch 72 and cathode data-driving switch 74 are expanded into CMOS inverters 81 and 82. In FIG. 9, the anode-scanning switch 72 and cathode data-driving switch 74 are expanded into two-stage CMOS inverters 91 and 92. The inverter chain presented in FIG. 9 can drive the organic thin-film EL element 71 with fast response under a higher output capacitance. The constant current source 73 in FIG. 7 for driving an organic thin-film EL element is expanded into a current mirror circuit 86 shown in FIG. 8 and 9. This current mirror circuit 86 includes a constant current N-channel MOSFET 84 which is connected between the cathode data-driving unit 82 and the organic thin-film EL element 71. A reference N-channel MOSFET 85 and a reference resistor 84 for generating a specified constant driving current to control the gate voltage potential of the constant current N-channel MOSFET 83. The Ohm magnitude of the reference resistor 84 can vary the driving current flowing into the organic thin-film EL element 71.

Figure 10:
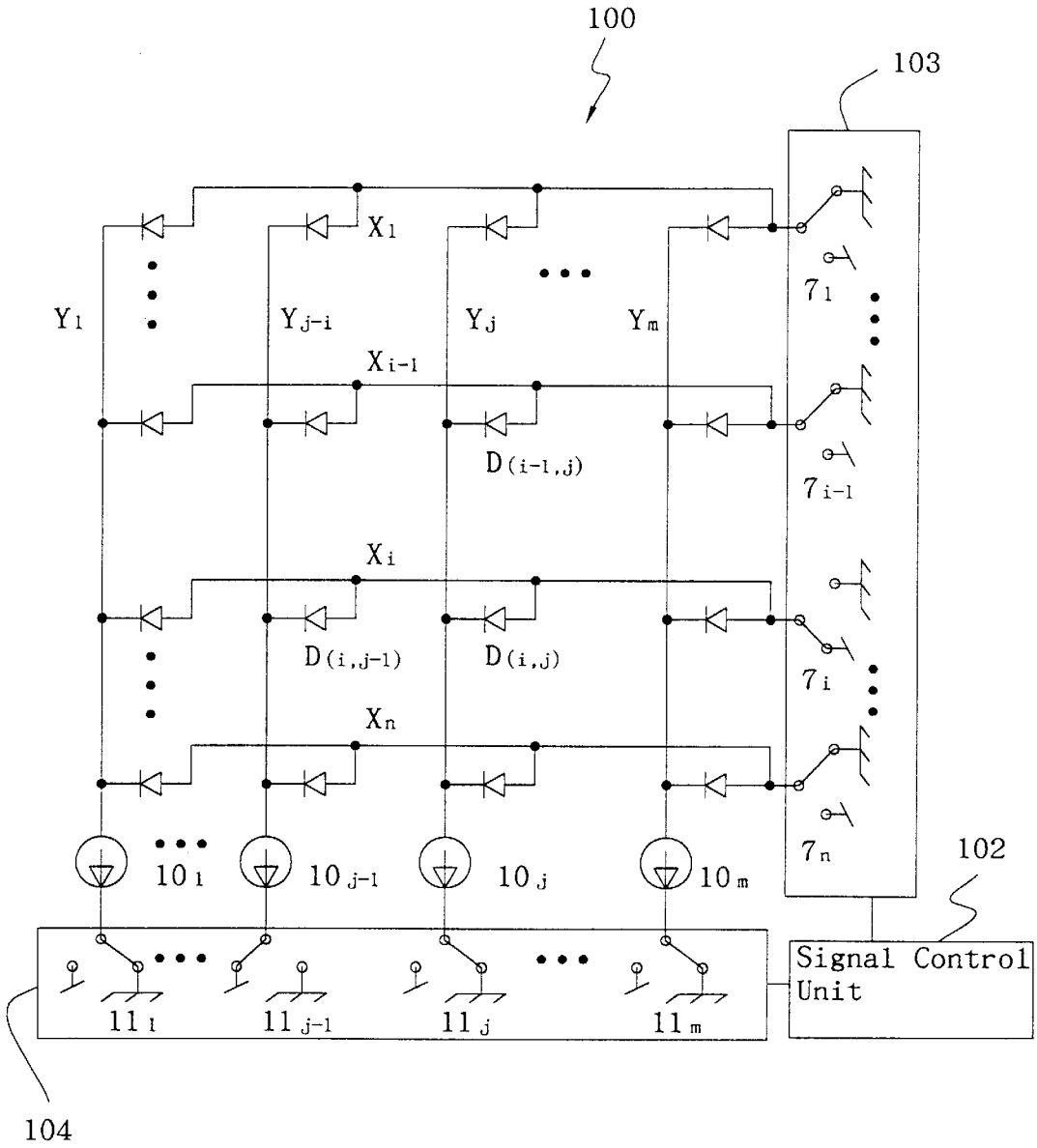
FIG. 10 shows a driving system structured by the driving circuit shown in FIG. 7.

FIG. 10 shows a driving system 100 structured by the driving circuit 70 shown in FIG. 7. In the driving system 100, anode-scanning lines $X_1$ to $X_n$ are connected to switches $\mathbf{7}_1$ to $\mathbf{7}_n$, respectively. Each of the switches $\mathbf{7}_1$ to $\mathbf{7}_n$ is connected to a power potential $V_B$ while the corresponding anode scanning line among $X_1$ to $X_n$ is selected or connected to a ground potential while the corresponding anode scanning line among $X_1$ to $X_n$ is not selected. Data-driving lines $Y_1$ to $Y_m$ are connected to constant current sources $\mathbf{10}_1$ to $\mathbf{10}_m$, respectively, which are further connected to switches $\mathbf{11}_1$ to $\mathbf{11}_m$. The data-driving lines $Y_1$ to $Y_m$ are set to the power potential $V_B$ for turning off the organic thin-film EL element 71, and set to ground potential for turning on the organic thin-film EL element 71. In FIG. 10, the switches $\mathbf{7}_1$ to $\mathbf{7}_n$ forms a anode scanning unit 103, the switches $\mathbf{11}_1$ to $\mathbf{11}_m$ forms a cathode data-driving unit 104, and the switches $\mathbf{7}_1$ to $\mathbf{7}_n$, and $\mathbf{11}_1$ to $\mathbf{11}_m$ are controlled by a signal control unit 102.

Figure 11:
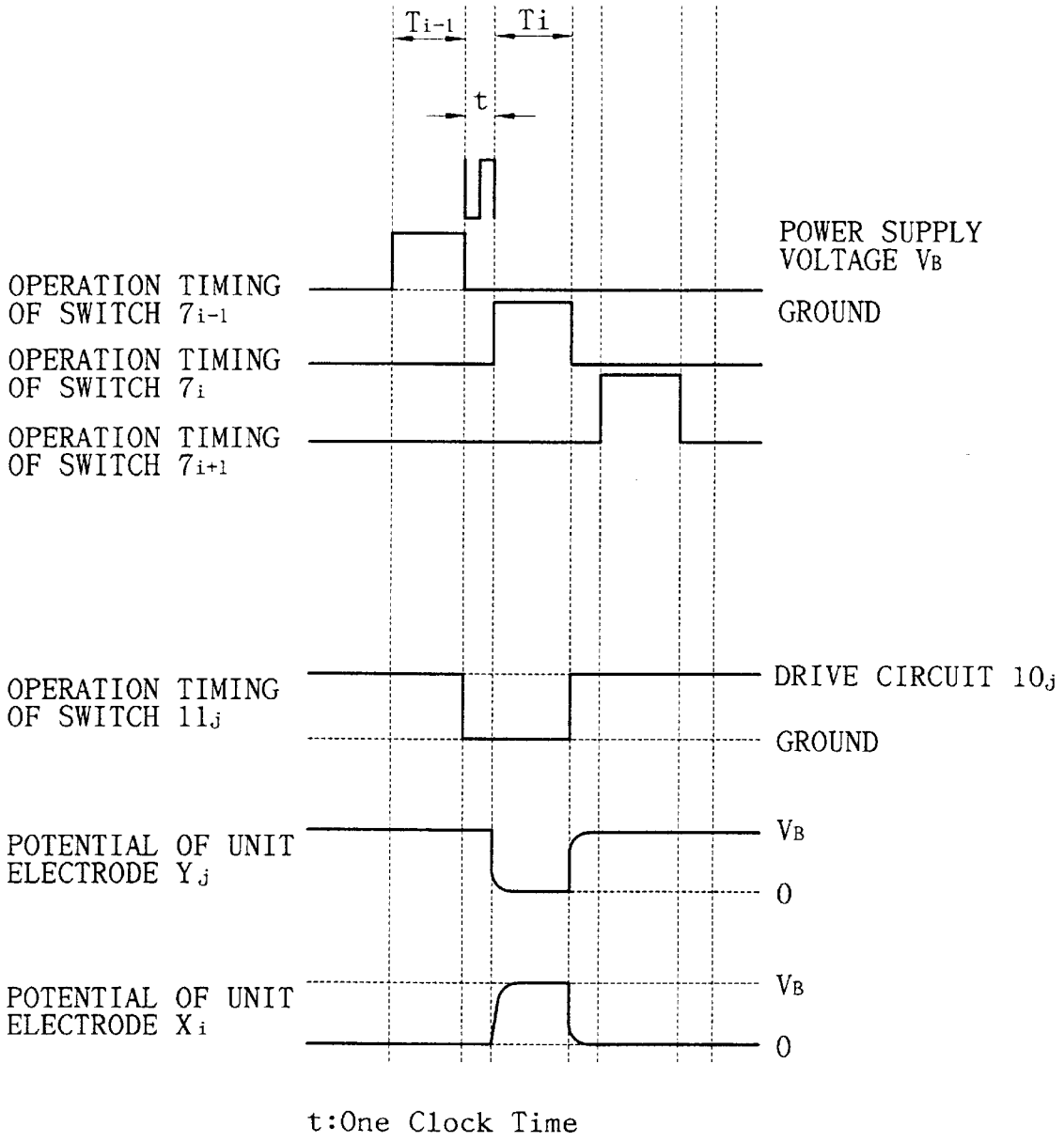
FIG. 11 shows a timing chart of the driving system in FIG. 10.

FIG. 11 shows a timing chart of the driving system 100. In FIG. 11, the operations of the switches $\mathbf{7}_{i-1}$, $\mathbf{7}_i$, $\mathbf{7}_{i+1}$ and $\mathbf{11}_j$ are listed, and change over time and potential of the anode scanning line $X_i$ and the data-driving line $Y_j$ are also provided. During a time period $T_{i-1}$, the anode scanning line $X_{i-1}$ is connected to the power potential since the switch $\mathbf{7}_{i-1}$ is switched to the power potential, and the cathode data-driving line $Y_j$ connected to the switch $\mathbf{11}_j$ through the constant current source $\mathbf{10}_j$ shows either in a power potential or a ground potential in accordance with a display data. At this time, if the cathode data-driving line $Y_j$ is connected to a power potential, as indicated by solid lines in FIG. 10, a zero bias is applied to a pixel D(i−1, j), and a reverse bias is applied from pixels D(1, j) to D(i−2, j) and from pixels D(i, j) to D(n, j) to charge the parallel capacitances of these pixels in a reverse bias direction. At time period t having at least one clock time, the switches $\mathbf{7}_1$ to $\mathbf{7}_n$ pull down the entire anode scanning lines $X_1$ to $X_n$ to ground potential. Accordingly, the storage capacitances of the pixels that have been charged in the reverse bias direction during the time period $T_{i-1}$ are discharged quickly during this time period t regardless of the constant current sources $\mathbf{10}_1$ to $\mathbf{10}_m$ and the potential of the cathode data lines. Thereafter, during a time period $T_i$, the anode scanning line $X_i$ is selected by a switch $\mathbf{7}_i$ and the switch $\mathbf{11}_j$ connected the cathode data-driving line $Y_j$ is switched to the ground potential. The potential of the anode scanning line $X_i$ increases immediately, and no delay occurs in emission of the pixel D(i, j).

Figure 12:
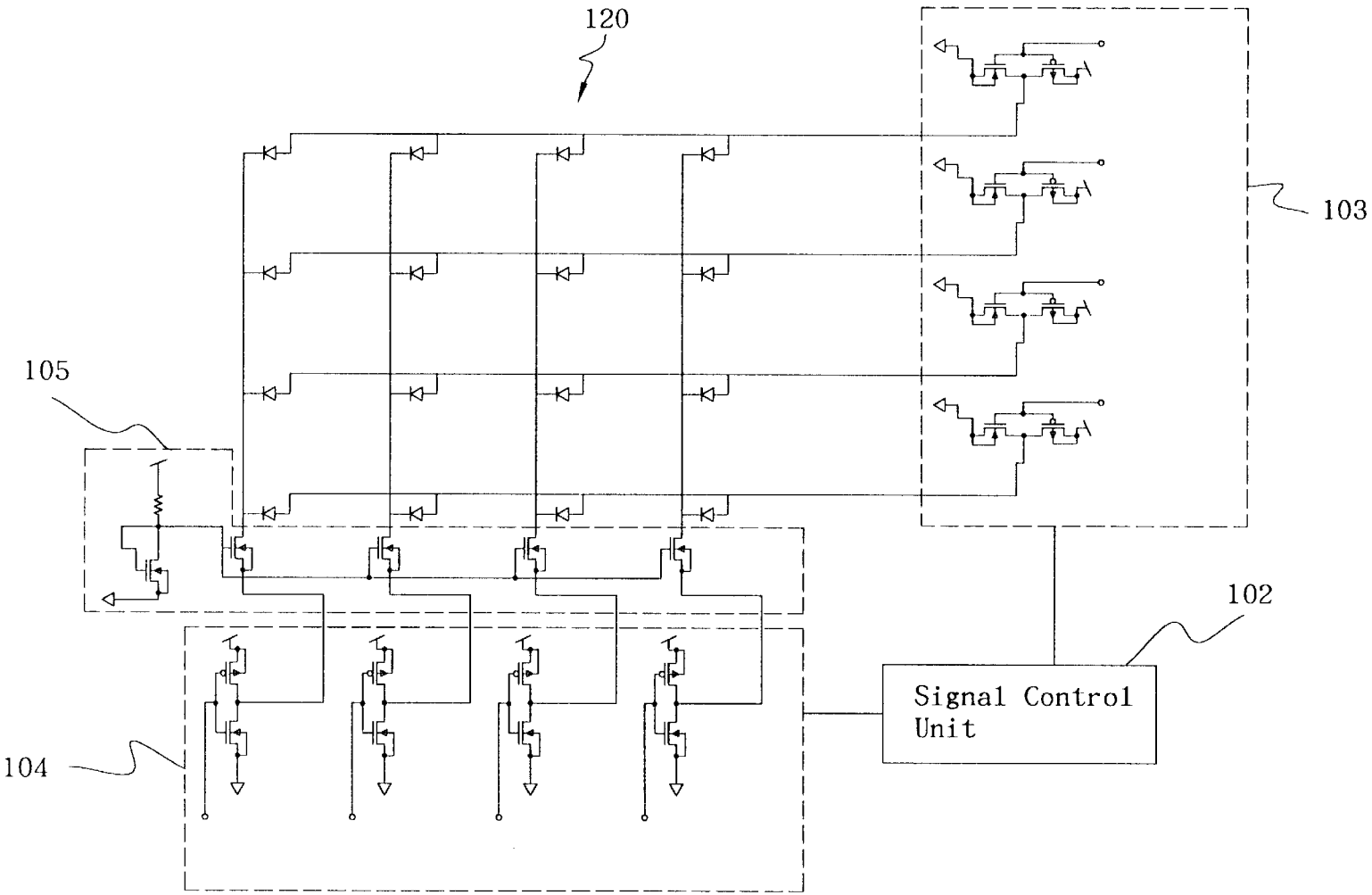
FIG. 12 shows an equivalent driving system to the structure in FIG. 10.
Figure 13:
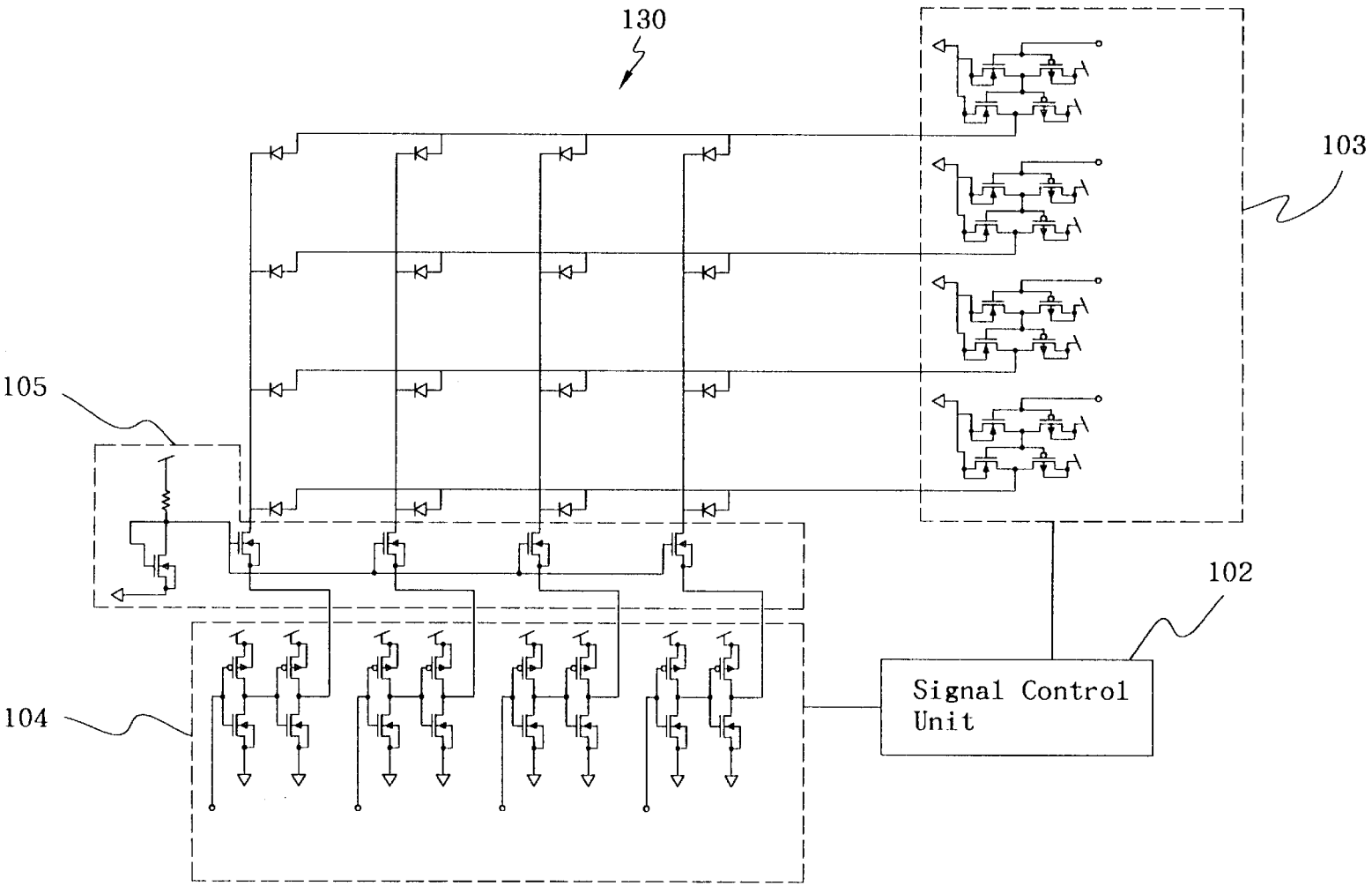
FIG. 13 shows an equivalent driving system to the structure in FIG. 10.

FIG. 12 and FIG. 13 show equivalent driving systems 120 and 130 to the structure in FIG. 10. In FIG. 12, each of the switches $\mathbf{7}_1$ to $\mathbf{7}_n$ in the anode scanning unit 103 and each of the switches $\mathbf{11}_1$ to $\mathbf{11}_m$ in the cathode data-driving unit 104 is expanded into a CMOS inverter; each of the constant current sources $\mathbf{10}_1$ to $\mathbf{10}_m$ is expanded into the structures 86 shown in FIG. 8 and all constant current sources $\mathbf{10}_1$ to $\mathbf{10}_m$ are grouped as a block 105. Relatively, in FIG. 13, each of the switches $\mathbf{7}_1$ to $\mathbf{7}_n$ in the anode scanning unit 103 and each of the switches $\mathbf{11}_1$ to $\mathbf{11}_m$ in the cathode data-driving unit 104 is expanded into a two-stage CMOS inverter, and each of the constant current sources $\mathbf{10}_1$ to $\mathbf{10}_m$ is expanded into the structures 83 shown in FIG. 8. The signal control unit 102 generates X and Y pulses based on the timing chart shown in FIG. 11.

The above-described embodiments of the present invention are intended to be illustrative only. Numerous alternative embodiments may be devised by those skilled in the art without departing from the scope of the following claims.

What is claimed is:

1. A circuit for driving an organic thin-film EL element, comprising:

an anode-scanning switch electrically connected to a power potential while the driven organic thin-film EL element is scanned and electrically connected to a ground potential otherwise;

an organic thin-film EL element electrically connected to the anode-scanning switch;

a constant current source electrically connected to the organic thin-film EL element; and a cathode data-driving switch, one end of the cathode data-driving switch electrically connected to the constant current source, the other end of the cathode data-driving switch electrically connected to a ground potential while the driven organic thin-film EL element is selected and electrically connected to a power potential otherwise.

2. The circuit of claim 1, wherein the anode-scanning switch includes at least one CMOS inverter.

3. The circuit of claim 1, wherein the cathode data-driving switch includes at least one CMOS inverter.

4. The circuit of claim 1, wherein the constant current source includes a current mirror circuit.

5. The circuit of claim 4, wherein the current mirror circuit includes:

a constant current N-channel MOSFET;

a reference resistor, one end of the reference resistor electrically connected to a power potential and another end electrically connected to a gate of the constant current N-channel MOSFET; and a reference N-channel MOSFET, a source of the reference N-channel MOSFET electrically connected to a ground potential, and a gate and drain of the reference N-channel MOSFET electrically connected to the gate of the constant current N-channel MOSFET.

6. A system for driving organic thin-film EL elements, comprising:

an anode scanning unit including m rows of anode-scanning switches, each anode-scanning switch electrically connected to a power potential while an organic thin-film EL element electrically connected to the anode-scanning switch is scanned and electrically connected to a ground potential otherwise, wherein m is an integer;

n columns of constant current sources, wherein n is an integer;

an m×n matrix of organic thin-film EL elements, the organic thin-film EL elements at the same row electrically connected to a corresponding anode-scanning switch, and the organic thin-film EL elements at the same column electrically connected to a corresponding constant current source;

a cathode data-driving unit including n columns of cathode data-driving switches, one end of each cathode data-driving switch electrically connected to the constant current source, another end of the cathode data-driving switch electrically connected to a ground potential while a corresponding organic thin-film EL element is selected and electrically connected to a power potential otherwise, and a signal control unit for generating control signals to switch the anode-scanning switches and the cathode data-driving switches.

7. The system of claim 6, wherein the anode-scanning switch includes at least one CMOS inverter.

8. The system of claim 6, wherein the cathode data-driving switch includes at least one CMOS inverter.

9. The system of claim 6, wherein the constant current source includes a current mirror circuit.

10. The system of claim 9, wherein the current mirror circuit includes:

a constant current N-channel MOSFET;

a reference resistor, one end of the reference resistor electrically connected to a power potential and the other end electrically connected to a gate of the constant current N-channel MOSFET; and a reference N-channel MOSFET, a source of the reference N-channel MOSFET electrically connected to a ground potential, and a gate and drain of the reference N-channel MOSFET electrically connected to the gate of the constant current N-channel MOSFET.

11. The system of claim 6, wherein a time gap exists between the time connecting to a power potential of neighboring anode-scanning switches controlled by the signal control unit.

12. The system of claim 6, wherein the selected cathode data-driving switch is electrically connected to a ground potential while the time gap starts.

* * * * *